US005445369A

United States Patent [19]

Golicz et al.

[11] Patent Number: 5,445,369

[45] Date of Patent: Aug. 29, 1995

[54] METHOD OF AND APPARATUS FOR MOVING DOCUMENTS

[76] Inventors: Roman M. Golicz, 26 Indian Dr., Clinton, Conn. 06413; Mark K. Lohrs, 482 Main St., Old Saybrook, Conn. 06475

[21] Appl. No.: 63,446

[22] Filed: May 18, 1993

[51] Int. Cl.[6] ..... B65H 5/00; B65H 29/00

[52] U.S. Cl. ..... 271/3.23; 271/12; 271/245; 271/276; 271/197; 271/202; 271/270

[58] Field of Search ..... 271/3, 5, 12, 245, 227, 271/276, 69, 194, 197, 202, 270

[56] References Cited

U.S. PATENT DOCUMENTS

| | | | |
|---|---|---|---|
| 2,852,256 | 9/1958 | Faulls et al. | 271/197 |
| 3,103,355 | 9/1963 | Hubbard et al. | 271/5 |
| 3,823,937 | 7/1974 | Hirafuji | 271/276 |
| 4,033,576 | 7/1977 | Stanfield | 271/5 |
| 4,200,276 | 4/1980 | Marschke | 271/202 |
| 4,307,661 | 12/1981 | Wilkins et al. | 271/197 |
| 4,886,263 | 12/1989 | Naito | 271/202 |
| 5,129,641 | 7/1992 | Long | 271/202 |

FOREIGN PATENT DOCUMENTS

| | | | |
|---|---|---|---|
| 0036240 | 2/1987 | Japan | 271/194 |

*Primary Examiner*—H. Grant Skaggs
*Attorney, Agent, or Firm*—Chilton, Alix & Van Kirk

[57] ABSTRACT

A paper transport is formed by a plurality of substantially identical conveyor modules which are arranged end-to-end and separated by gaps selected as a function of active devices which are to be installed along the paper path defined by the transport. The conveyor modules each include plural conveyor belts and documents are held against the belts for transport there through the creation of a small pressure differential thereacross, the pressure differential resulting from establishing a large volume air flow through the conveyor modules, the same air flow being employed for cooling the electronic components of the active devices associated with the transport.

20 Claims, 6 Drawing Sheets

METHOD OF AND APPARATUS FOR MOVING DOCUMENTS

BACKGROUND OF THE INVENTION

1. Field of the Invention

The present invention relates to the transporting of individual documents and particularly to the controlled uninterrupted movement of indicia bearing sheets of paper, withdrawn from a stack of sheets, past the image capture device of an optical character recognition apparatus. More specifically, this invention is directed to apparatus for continuously transporting documents in serial fashion past a work station and especially to a paper conveyor of modular design for use in conjunction with document scanning apparatus such as in OCR and other imaging applications. Accordingly, the general objects of the present invention are to provide novel and improved methods and apparatus of such character.

2. Description of the Prior Art

Many business machines, machines which copy documents and computer controlled printers for example, include a paper transport. The paper transport has acquired the reputation of being the "weak link" in such machines, i.e., equipment malfunctions or "jams" most often occur in the extraction of a page from a stack or during the transport of an extracted page through the machine. In addition to being the most prevalent source of malfunction, existing paper transports often impose the limitation on the upper rate of document throughput.

It is a truism that the more sophisticated the application, the more troublesome will be any malfunction associated with a document transport. While not limited thereto in its utility, the present invention is particularly well suited for perhaps the most demanding application which requires that single sheets of information bearing paper be moved past a work station, namely applications which include document imaging such as optical character recognition. In order to justify the cost of the optical character recognition hardware and software, or other imaging application associated computer hardware and software, the user must be assured of reliable operation and a high document throughput rate. Thus, the paper transport which is coupled to the application dictated hardware must be characterized by a high degree of reliability and particularly minimization of "jams". Also, where complex de-shewing electronics is not employed, the transport must also be characterized by the ability to ensure that the documents being "read" are properly oriented relative to the "camera" and securely held in the established orientation during movement. Additionally, since the imaging of a document will typically be performed with the document moving at a slower velocity than the maximum reliably obtainable transport speed, a paper transport for an OCR application will optimally have the capability of moving a document at plural speeds, i.e., a "reading" velocity and a faster downstream velocity.

Previously available paper transports have failed to meet one or more of the above-listed requirements, i.e., reliability, de-skewing, secure transport and the ability to change transport speed. Additional requirements of a high performance paper transport system include ease of installation and maintenance, and particularly the ability to quickly and easily clear jams. A further desirable attribute of a high performance transport would be a configuration which permitted the user a degree of flexibility in locating work stations, such as imaging devices, microfilm cameras and printers, and also flexibility in the choice of work station device. Also, the optimal transport for an OCR application would ensure that the documents being processed are treated gently and move constantly through the work station areas, i.e., there is no stop and start motion which might produce misalignment. The optimal transport would also provide for constant velocity document motion in the work station area(s). As another requirement, since most OCR applications require that documents be serially processed in the order in which stacked, the transport system should preferrably include document justification including the capability of detecting an inadvertent multiple page feed or the absence of a document.

SUMMARY OF THE INVENTION

The present invention satisfies all of the above-briefly discussed criteria and, in so doing, provides a novel method and apparatus for feeding and transporting, for subsequent stacking, indicia bearing sheets of paper. Apparatus in accordance with the invention comprises a modular, high performance paper transport which is particularly well suited for use in OCR and other imaging applications.

In a transport in accordance with the present invention, the paper path is defined by a feeder and a main document conveyor of modular construction. The paper path will typically terminate, at the downstream end of the main conveyor, at a document stacker. The feeder, while not in itself novel, is uniquely mounted so as to become a module of the transport system. The feeder is supported on slides over the main document conveyor. Accordingly, the feeder position may be adjusted to accommodate different size documents and to permit the manual feed of documents.

The modules of the conveyor each comprise a plurality of parallelly arranged moving belts. The speed of the belts of the feeder, i.e., the belts on which a document being extracted from the feeder moves, may be controlled independently of the main conveyor belt speed. The feeder belt speed will not, however, exceed the main conveyor belt speed. This ability to move documents on the main conveyor at a higher speed than on the feeder results in the advantage that inter-document gaps at the first active device are increased and the ability to separate overlapped documents, i.e., doubles, is also enhanced.

In accordance with one embodiment of the invention, movable fingers are employed to de-skew in-feeding documents. Sensors may be positioned adjacent the exit end of the conveyor module which is positioned immediately upstream of the first work station to confirm that a document is present and that only one document has been released for processing for each feed cycle. One or both of these sensors may also be used to detect overlapped documents. The feeder may be run in a continuous feed mode or may be cycled on and off to implement a demand feed mode.

Apparatus in accordance with the invention, as noted, includes a main conveyor which transports the serially in-fed documents past the various active, i.e., imaging and printing, devices that may be located along the main conveyor. The documents will typically be transported face-down but may, alternatively, may be transported face-up or may have indicia on both sides.

Transporting the documents in a face-down orientation affords the significant advantage that devices such as cameras and printers may be located beneath the paper path and thus do not restrict operator access to documents that need to be manually cleared. As added advantages, the face-down movement enables the system which includes the transport to be more compact and permits the stacker design to be simplified because the documents do not have to be turned around in the stacker after processing in order to maintain document order.

The belt path, i.e., the paper path, of apparatus in accordance with the invention consists of a series of substantially identical conveyor modules arranged end-to-end. The work stations, i.e., the active devices such as an OCR camera or ink jet printer, are located at the interfaces between the conveyor modules. The gaps between the modules are adjustable to meet specific device requirements while maintaining system modularity.

Documents being moved along the belt path of a transport in accordance with the invention are held against the moving belts by creating a small pressure differential across the documents. This pressure differential results from establishment of air flow through holes which are located between the plural belts of each conveyor module. The hold-down technique implemented in the transport is based upon the establishment of a high volume flow to establish a low pressure. In the operation of the preferred embodiment of the invention, the hold-down pressure is created in a plurality of the conveyor modules by coupling the modules to a common planar chamber which, in turn, is coupled to a single blower. The use of such a low pressure system for conveying documents makes operator access for the clearing of jams simpler and quicker and prevents excessive damage to documents that may be involved in a jam. Additionally, and most important in today's workplace, the use of a low pressure system, as opposed to the vacuum systems employed on many prior art paper transports, greatly reduces acoustical noise.

In the practice of the present invention, where a particular active device requires a large separation between two successive conveyor modules, an inverted conveyor module is utilized. Such an inverted conveyor module will span the gap between the adjacent upstream and downstream conveyor modules. In the case of an inverted conveyor module, the hold-down pressure will be applied in reverse to draw the documents up and transport them across the gap and, in such case, the inverted conveyor module will typically have fans associated therewith.

The air flow system of the preferred embodiment of the present invention is also multi-function in that at least part of the flow which produces the document hold-down force is also utilized to conduct heat away from any electronics subsystems located underneath the conveyor. Thus, the electronics of the active devices with which the transport is associated will be cooler by causing air to flow thereover and directing this warmed air to the region above the paper path. The warm air is subsequently drawn down through conveyor modules and exhausted to the ambient environment by the blower.

The present invention, also through the use of an inverted conveyor module, permits the velocity of documents being processed to be changed. Thus, parts of the conveyor system may be run at different belt speeds thereby, for example, permitting "slow" devices to operate on the document at one belt speed and then accelerating the document to a higher speed for processing by "faster" devices, i.e., the belts of the conveyor modules upstream and downstream of an inverted conveyor module may be caused to move at different speeds.

BRIEF DESCRIPTION OF THE DRAWINGS

The present invention may be better understood, and its numerous objects and advantages will become apparent to those skilled in the art, by reference to the accompanying drawings wherein like reference numerals refer to like elements in the several figures and in which.

DESCRIPTION OF THE DISCLOSED EMBODIMENT

Figure 1:
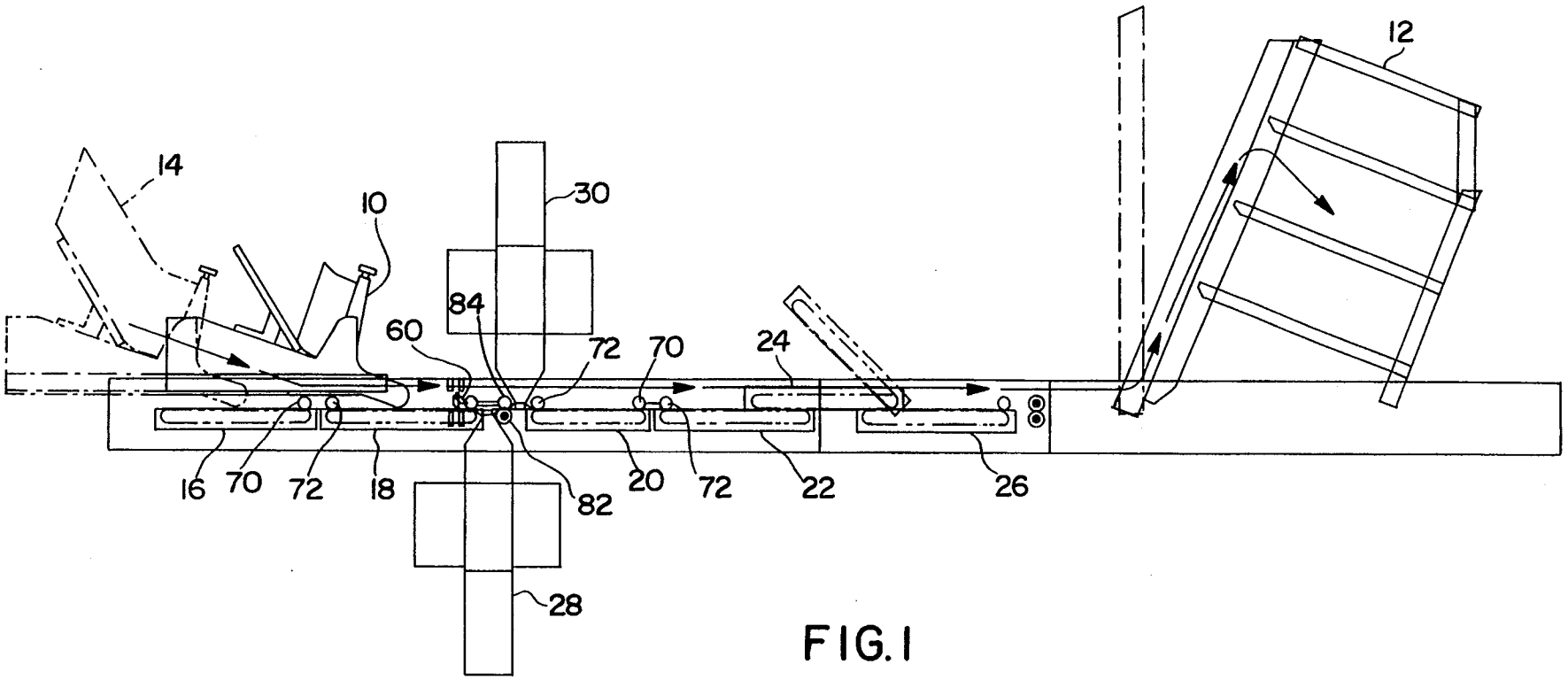
FIG. 1 is a schematic, side elevation view of a preferred embodiment of a modular transport system in accordance with the invention, FIG. 1 also depicting a document stacker at the downstream end of the transport and a pair of image capture devices positioned along the transport path.

A paper transport in accordance with the present invention is shown schematically, and isolated from the supporting cabinetry, in FIG. 1. The transport shown in FIG. 1 defines a paper path, indicated by arrows, between a feeder 10 and a stacker 12. Neither the feeder nor the stacker comprise part of the present invention. The transport path for indicia bearing sheets of paper withdrawn from the bottom of a stack of sheets 14 loaded in feeder 10 is defined by a plurality of substantially identical conveyor modules, one of these modules being shown in perspective in FIG. 7, which are arranged end-to-end. It is to be noted, in the interest of facilitating understanding of the invention, that the directional arrows on FIG. 1 have been shown above the actual paper path, i.e., the paper will move from module to module held against the plural belts of each conveyor module. The conveyor modules, progressing in the downstream direction from feeder 10, are indicated at 16, 18, 20, 22, 24 and 26. The feeder 10 is removable from the transport and thus itself constitutes a module. Feeder 10 is mounted on drawer type slides and thus may be moved along the paper path between the positions shown in broken and solid lines on FIG. 1 to thereby accommodate documents having different dimensions in the direction of movement thereof and to permit the manual feeding of documents. The stacker 12 may also be removably mounted and will be supported such that its angle of inclination relative to the paper path may be adjusted.

Figure 2:
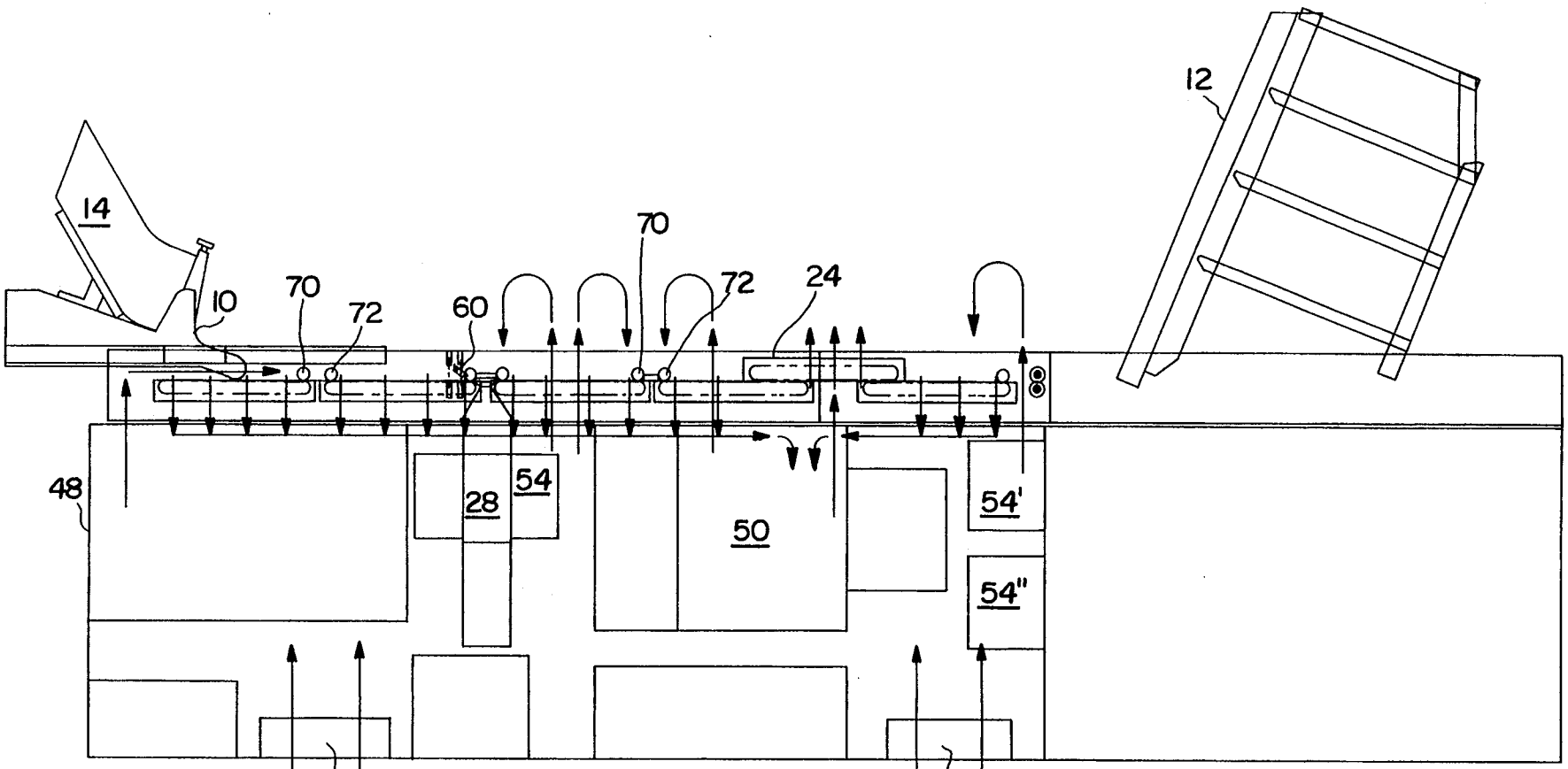
FIG. 2 is a view similar to FIG. 1 which schematically illustrates the electronic cabinets beneath the transport of FIG. 1, FIG. 2 also showing the air flow paths which generates the document hold-down force for the conveyor modules.
Figure 7:
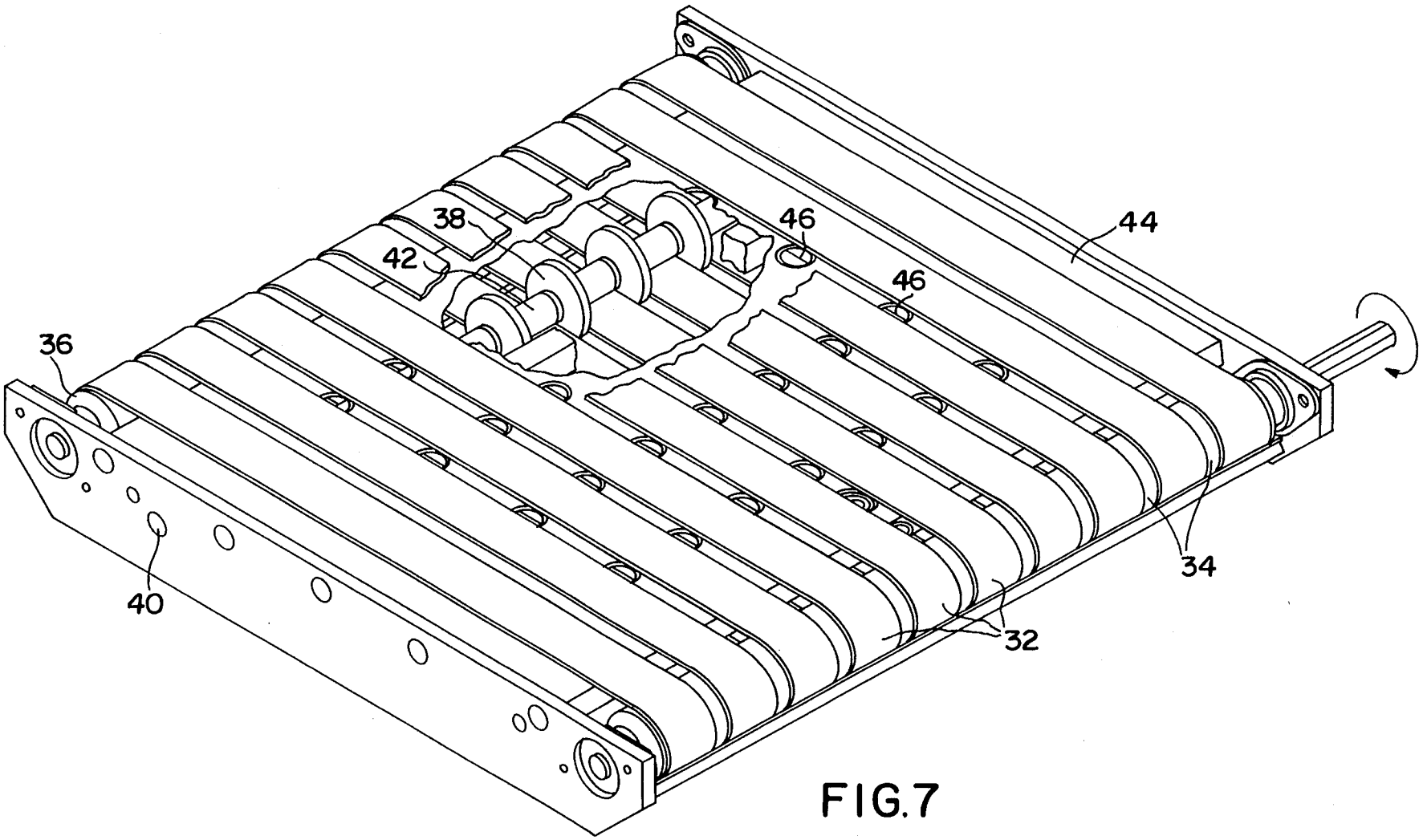
FIG. 7 is a perspective view, partly broken away to show detail, of a conveyor module of a transport system in accordance with the invention.

In accordance with the present invention, the gaps between adjacent of the conveyor modules may be varied as a function of the particular application. Restated, the modular design of the present transport provides wide latitude in the choice of the active devices, i.e., the work stations, which are to be located along the paper path. In FIG. 1 a pair of image capture devices 28 and 30, i.e., OCR cameras, are shown as located in the gap between conveyor modules 18 and 20. In most applications, as depicted in FIGS. 2 and 7, only the image capture device 28 which is positioned beneath the paper path will be utilized. However, as indicated in FIG. 1, active devices may be positioned above and/or below the paper path and such active devices may be located in the same gap or in the gaps between different pairs of adjacent conveyor modules.

Figure 5:
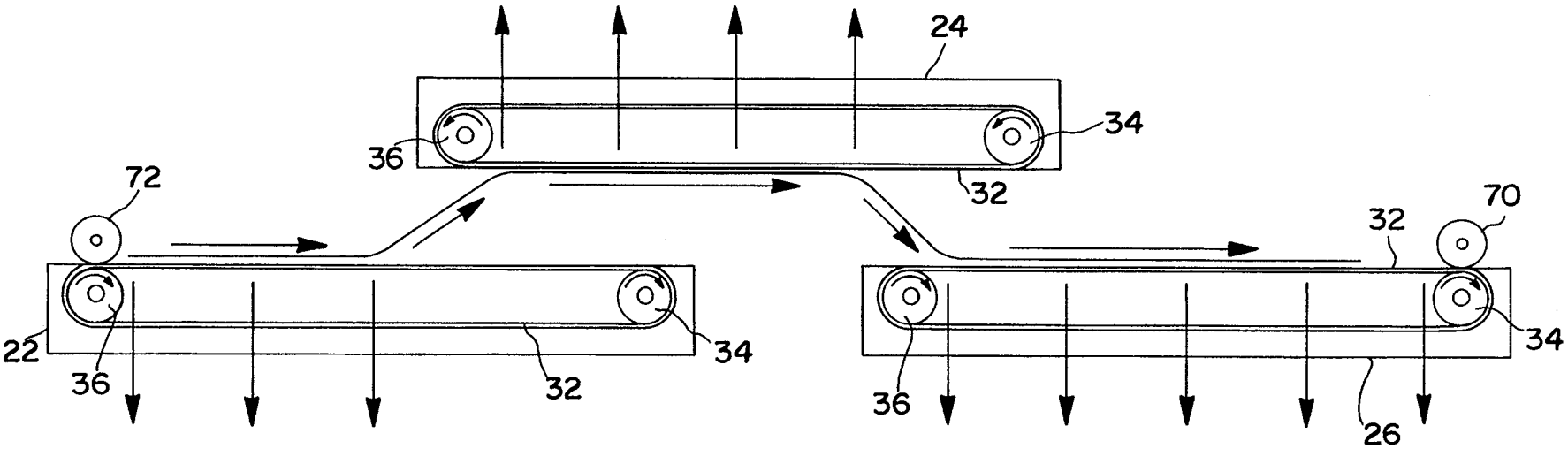
FIG. 5 is an enlarged view of three serially arranged conveyor modules of a transport system in accordance with the invention, the intermediate module of FIG. 5 being inverted.

As also indicated in FIG. 1, and as shown in more detail in FIG. 5, if it is desired to accelerate or decelerate a document, or if the gap dictated by a particular active device is too large for the documents being processed to reliably pass to the conveyor module located downstram of the actice device, an inverted conveyor module may be utilized. Such an inverted module has been indicated at 24 and, as indicated in FIG. 1, will typically be pivotally mounted so as to facilitate the clearing of any paper jams which may occur.

In accordance with the preferred mode of use of the present invention, the documents to be processed are transported face down along the paper path. Such face-down transport is advantageous because, among other reasons, it does not require the inversion of the documents at the stacker in order to preserve their original order. Also, face-down transport permits all of the active devices along the paper path to be located below the path whereby operator access to the paper path is unimpeded.

As may be seen from FIG. 7, each conveyor module comprises a plurality of parallel endless conveyor belts 32 which are coupled to a common drive. In the preferred embodiment, a common power source provides power for driving the belts of all of the conveyor modules, the actual conveyor module drives being coupled to the common power source via chains or drive belts. Thus, by changing sprocket or pulley diameter, the velocity at which a document is advanced across each conveyor module may be selected. Also in the preferred embodiment, the pulley or sprocket diameters are selected for the particular application and any subsequent changes in transport speed are obtained by using a variable speed drive motor as the power source. The speed of the belts of the internal conveyor of feeder 10 will be adjustable but will never exceed, and will typically be less than, the speed of the belts of the conveyor module on which the documents extracted from the feeder are deposited. The drive arrangement for the individual conveyor modules also, as will be described in more detail in the discussion of FIG. 5, permits a document moving along the paper path to be accelerated. An important feature of the invention resides in the fact that a document released onto the main conveyor, i.e., a document which is received at the first active device downstream of the feeder, will thereafter undergo uninterrupted forward motion. Restated, in the practice of the present invention documents which are scanned are moving at a constant velocity. The avoidance of stop and start motion of the documents significantly reduces the potential for jams and misalignments which could compromise the operation of the active devices located along the paper path.

As should be obvious from the above discussion, documents being processed are transported on each conveyor module by means of a system of roller driven belts 32. In the module of Figure 7, there are ten endless belts 32 which pass around a driven roller 34 and an idler roller 36. The proper spacing and parallelism of the belts 32 is maintained by belt guides which comprise discs 38 rotatably supported on an axle 40. The proper separation between the discs 38 is maintained by means of spacers 42 which are also located on axle 40. The discs 38 extend into the spaces between the belts 32 on the underside of the conveyor module and thus prevent axial movement of the belts relative to the rollers 34, 36. As shown, the spacer discs 38 are located, in the direction of travel of belts 32, a short distance upstream of where the belts are engaged by idler roller 36.

Continuing to discuss the conveyor modules, each module has an upper plate 44 which is provided with a pattern of apertures 46, the apertures being located so as to be in registration with the spaces between the belts 32. During movement across each conveyor module, a document is held against the parallel belts 32 by means of the creation of a comparatively small pressure differential between the upwardly and downwardly facing sides of the document. This hold-down pressure differential is induced by causing air to flow between the belts 32 and into the apertures 46. The direction of air flow is represented by arrows on Figure 5 for the individual conveyor modules while the air flow for the entire transport and the system with which it is associated is similarly depicted by means of arrows on FIG. 2. The use of a low hold-down pressure in accordance with the present invention may be contrasted with the vacuum hold-down technique typically employed on prior art paper transports and offers and number of significant advantages including making the clearing of jams simpler and quicker and preventing excessive damage to documents that may be involved in a jam.

Referring to FIG. 2, it may be seen that the direction of flow for the air which generates the hold-down pressure for the documents being transported is downwardly, i.e., toward the base of the supporting cabinetry 48, through all of the conveyor modules with the exception of the inverted module 24. In the case of module 24, the air flow must be in the opposite, i.e., upward, direction and for this purpose the module 24 will be provided with internal fans, not shown. In one reduction to practice, four fans were provided in conveyor module 24. Additonally, in the same reduction to practice, the conveyor modules located directly under the feeder 10 were also provided with internal fans because these modules can not, because of the feeder, be efficiently pneumatically coupled to the space above the downstream located conveyor modules.

As noted above, rather than employ a vacuum hold-down as has characterized the prior art, the present invention relies upon a high volume of air flow through the conveyor modules to create a low hold-down pressure. This high volume flow is, with the exception of modules 16, 18 and 24 as discussed above, generated by means of a blower, indicated schematically at 50, which may be of the squirrel cage type. Blower 50 communicates, by means of duct work, to a plenum chamber which is coupled to the undersides of the serially arranged conveyor modules. Blower 50 establishes a high volume air flow through the modules, and this flow is discharged into the ambient atmosphere. This high volume air flow induces flow from the ambient atmosphere into the cabinetry 48 via air inlets 52. The inflowing air is routed so as to cool the electronics, required for the particular application, which will be located within the cabinetry 48. The electronics packages will themselves be modular, as represented by blocks 54, 54', etc. and will each be ducted into the space above the paper path. It must be noted that the cover portion of the cabinetry 48, i.e., the portion which may be opened by the operator should a jam occur, has been omitted from the drawings in the interest of facilitating understanding of the invention but is represented in FIG. 2 by the reversal of direction of the air flow which is drawn through the electronic equipment modules 54 and caused to turn 180° and flow downwardly through the conveyor modules. The utilization of high volume air flow to generate a low pressure document hold down force provides a very substantial reduction in noise when compared to the prior art vacuum hold-down systems.

Figure 3:
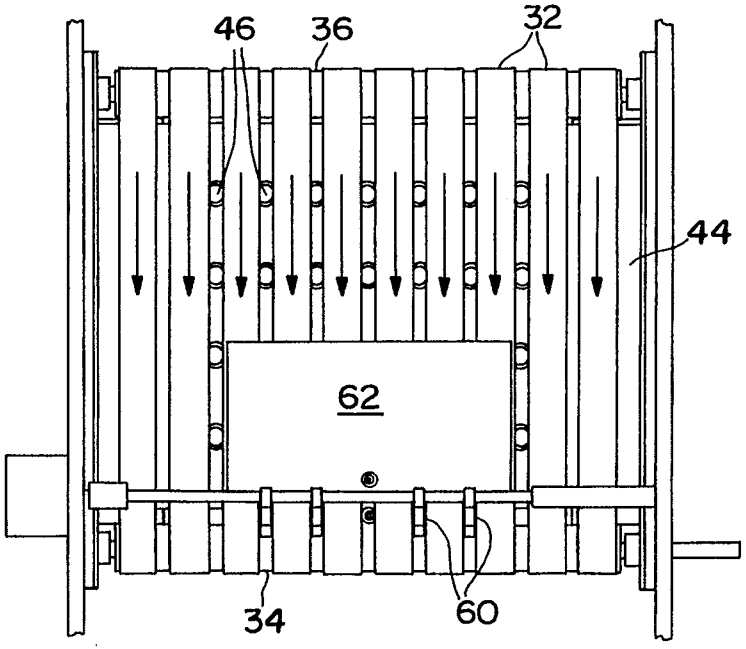
FIG. 3 is a top view of the feeder section of the modular transport system of the present invention, FIG. 3 showing a stationary document.
Figure 4:
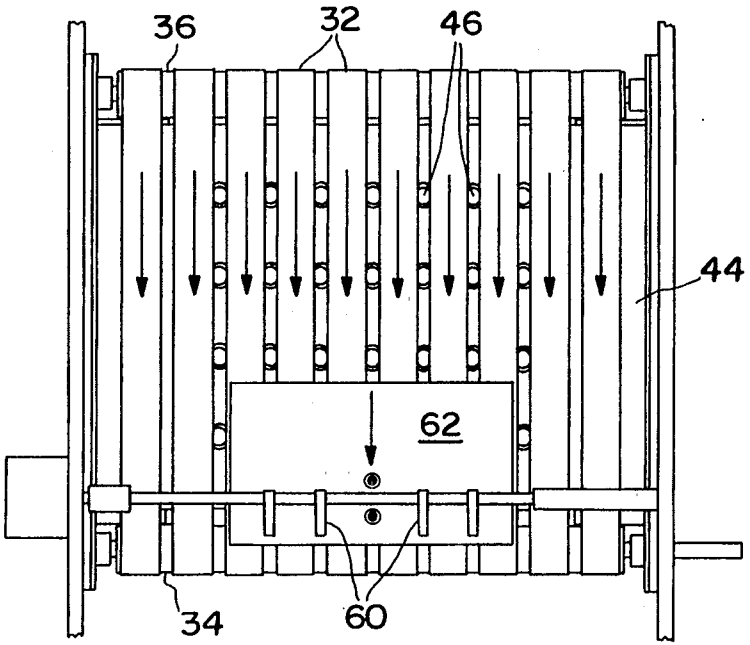
FIG. 4 is a view similar to FIG. 3 but depicting the document after release.

A transport in accordance with the present invention may operate simply by acquiring each document as it is released from feeder 10 and transporting that document continuously along the paper path. During such transport, as the document passes over the gap in which an active device is located, the document will move at a constant speed. In such a feed mode, the character recognition apparatus will typically have the capability of electronically de-skewing the documents being processed if any of the documents are misaligned. Alternatively, the user may select an automatic document de-skewing mode of operation. In the automatic de-skewing mode, as depicted in FIGS. 3 and 4, the document received from the feeder 10 will be momentarily stopped on conveyor module 18 incident to the de-skewing, and then will be released for processing. The mechanism which accomplishes the de-skewing comprises mechanical fingers 60 which are pivotally supported adjacent the downstream end of conveyor module 18. The fingers 60 may be seen from FIGS. 1–4 and 6. FIG. 3 shows a document 62 which has had its forward motion momentarily arrested by the fingers 60 while FIG. 4 represents the same document immediately subsequent to release as a result of the fingers 60 being pivoted out of the paper path to the position shown in FIG. 6. The fingers 60 cooperate with electronic sensors, which will be described below, to justify the document which will be processed, i.e., the presence of the document will be verified, the document will be squared and the squared document will then be released in the proper sequence. The squaring operation performed by fingers 60 is made possible by the use of a small hold-down pressure differential, i.e., the belts 32 can continue to move relative to an arrested document without danger of the document being crumpled or otherwise damaged.

Figure 6:
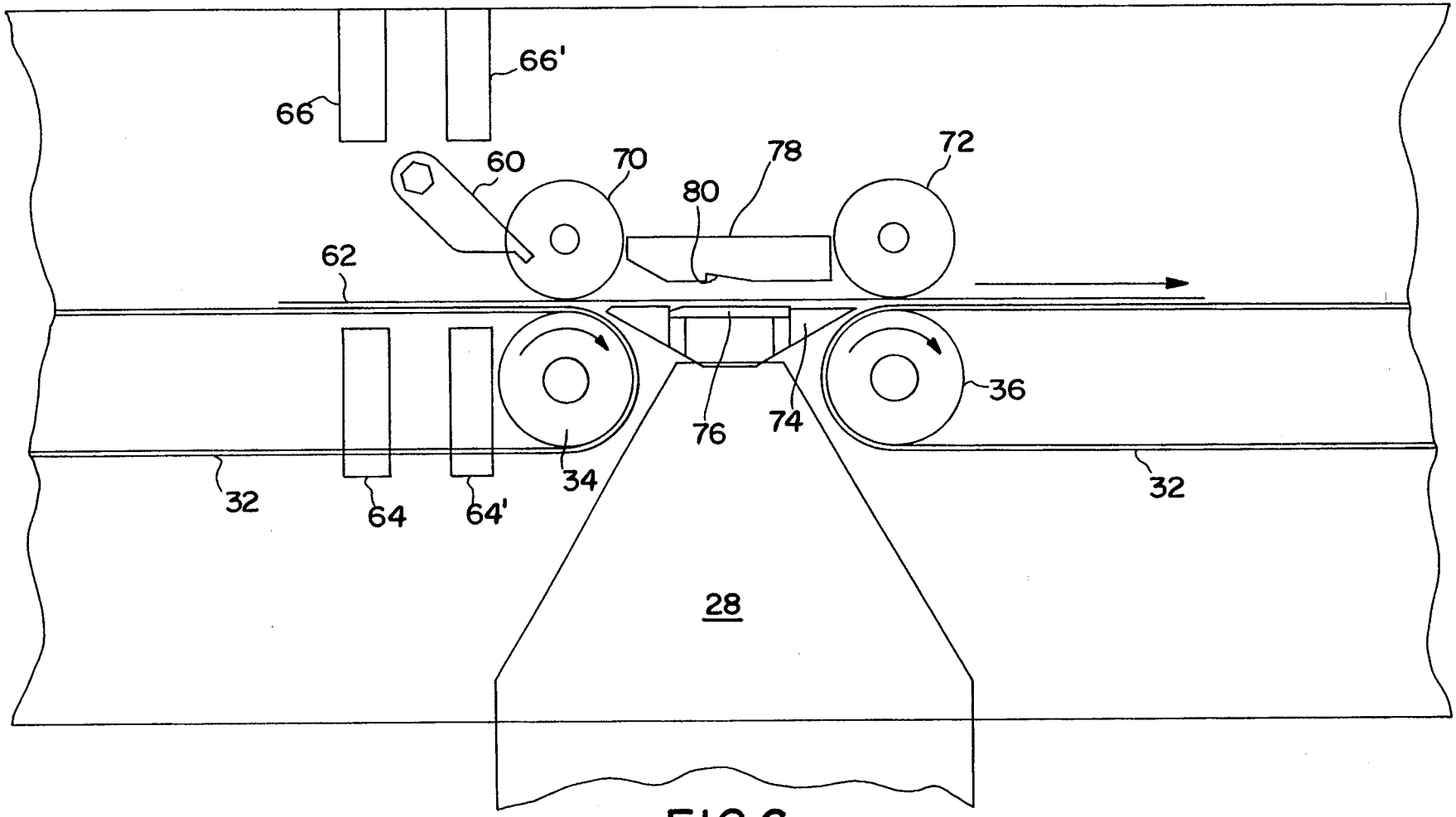
FIG. 6 is an enlarged, partial side-elevation view of a transport system in accordance with the present invention in the region of the gap between a pair of successive conveyor modules, an image capture device being shown schematically in the gap.

The electronic sensing which may be employed in the above-discussed document justification includes photoelectric devices which are represented schematically in, and thus may also clearly be seen from, FIGS. 3, 4 and 6. These photoelectric devices are located both upstream and downstream of the transverse plane in which the leading edge of a document is momentarily stopped by the fingers 60. Referring to FIG. 6, the upstream and downstream photoelectric devices respectively include light emitters 64, 64' and associated light responsive detectors 66, 66'. The upstream photoelectric device 64, 66 detects the presence of a document while the downstream sensor 64', 66' provides a signal which confirms the release of a document. The output signals provided by the upstream and downstream detectors are utilized in document tracking. The upstream detector may also be employed to detect a plural document feed malfunction. That is, the sensitivity of the receiver 66 may be set so that, considering the nature of the documents being processed, the magnitude of the receiver output signal, which is a function of the amount of attenuation of the light from emitter 64 which is caused by the document(s), will indicate whether more than one sheet is being fed.

As mentioned above, the use of a low pressure differential to hold the documents against the belts of the conveyor module permits the documents to be de-skewed without any danger of wrinkling or other damage. Similarly, the use of a low hold-down pressure ensures that the documents will remain essentially flat over their entire surface, i.e., any undulations in the document surface will be not greater than 0.100 inches.

Continuing to refer to FIG. 7, when a document 62 is released by the fingers 60 it will be engaged on its upwardly facing side by a pinch roller 70 which cooperates with, and is driven by, the belts of conveyor module 18. In the disclosed embodiment, roller 70 is in axial vertical registration with the driven roller 34 of conveyor module 18. The roller 70 will ensure that the document 62 will be propelled across the gap where the active device, i.e., the image capture device 28 which may be part of an OCR apparatus, is located. At the downstream side of the gap, a further pinch roller 72, which cooperates with and is driven by conveyor module 20, will engage the document 62 and ensure that it is moved on to the downstream conveyor module where it will be retained by the hold-down pressure differential while being transported along the paper path by the parallel belts 32. As may be seen from FIGS. 1 and 2, there will be at least a pair of pinch rollers 70, 72 respectively located upstream and downstream of each gap between adjacent conveyor modules with the exception of a gap, such as shown in FIG. 5, where an inverted conveyor module is utilized to reliably ensure that the document will pass over a large gap during its continuous motion. The pinch rollers provide a positive grip on the documents and thus ensure constant document speed in the gap regions.

In the use of a modular transport embodying the present invention, a document may be caused to traverse a gap in which an active device or devices are installed solely under the influence of rollers. Thus, in the region where a pair of oppositely disposed image capture devices 28 and 30 are situated, i.e., in the gap between the conveyor modules 18 and 20 of FIG. 1, a cooperating pair of drive roller 82 and pinch roller 84 are located intermediate the active devices and thus also intermediate the upstream and downstream conveyor modules. A document being processed may thus traverse the gap between conveyor modules 18 and 20 solely under the influence of rollers, i.e., the document exiting from under pinch roller 70 will be caused to move into engagement with pinch roller 72 due to the action of the intermediately disposed roller pair 82, 84.

Continuing to discuss FIG. 7, when the transport forms part of optical character recognition apparatus, a read area cover 74 will be provided in the region where the document passes in front of an image capture device such as camera 28. The read area cover 74 includes a lens 76, i.e., a transparent member or window, through which the document may be illuminated so that an image of the illuminated portion thereof may be captured. Lens 76 is provided, on its upstream facing edge, with a beveled portion which serves to ensure that a damaged edge region of a document being processed will not hang-up on a discontinuity between the lens 76 and the upstream portion of the read area cover 74. As may also be seen from FIG. 6, the read area cover 74 is designed such that the level of the upper surface thereof drops in steps between the leading and trailing edges thereof, i.e., the planar portion of cover 74 first contacted by the moving document is at a higher level than the document contacting surface of lens 76 and the planar surface of lens 76 is at a higher level than the adjacent surface of the read area cover located downstream thereof in the direction of document travel. This "waterfall" shape also serves to prevent any movement impeding contact between an edge portion of a document and cover 74.

A back-up member 78 is provided in the camera region on the opposite side of the paper path from read area cover 74. The back-up member 78 is provided with a notch 80 having a surface which is oriented at an angle with respect to the plane of the paper path. The angled surface of notch 80 functions to reflect illuminating light which passes through the document away from the image capture device 28. The surface of the back-up member 78 in the region of notch 80 will be provided with a dull finish. The orientation of notch 80 ensures that the leading edge of a document cannot catch on any abrupt edge during the forward motion of the document.

Referring now to FIG. 5, an inverted conveyor module such as indicated at 24 may be employed where a large gap is required between a pair of successive conveyor modules by the nature of the active device which is to be positioned in that gap and/or when it is desired to change the transport speed of the document. If the document is to be accelerated, the inverted conveyor module 24 and the downstream conveyor module 26 will both be operated at the same belt speed and this belt speed will be greater than that of conveyor module 22. As shown in Figure 5, there will be a degree of overlap between the inverted module and the cooperating upstream and downstream conveyor modules. A document being transported entirely on conveyor module 22, i.e., a document which has been released from contact with pinch roller 72, will be acquired by conveyor module 24 and will be brought up to the new, higher speed. When the document is transported solely on conveyor module 24, it will have reached the new constant speed and can be operated upon by an active device located in the gap between conveyors 22 and 26. An active device which may require a large gap between two conveyors would be an ink jet printer for use in serializing the documents being processed. A document, having reached its new transport velocity on inverted module 24, will be transferred from conveyor module 24 onto the belts of conveyor module 26 and will continue along the main conveyor at the new speed. The separation of a document from the belts of conveyor module 22 and the transfer thereof to the belts of conveyor module 24 results from the fact that, as indicated by the air flow arrows of FIG. 5, the upper plate 44 of module 22 will not have any apertures 46 in the area which is overlapped by module 24. Similarly, the plate 44 of module 24 will not have any air flow passages in the area where module 24 overlaps module 26.

A particularly unique feature of the present invention resides in the fact that the scanning of a document will be done in a region where there is no back-up conveyor mechanism. This may be contrasted with the prior art where a document is customarily imaged from above while face-up on a belt and being held down by an applied vacuum. Also, in the prior art it is conventional practice to move the document in steps, i.e., the document is stopped for scanning, whereas documents are scanned while moving at a constant speed in the practice of the present invention.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A paper transport for imparting motion to indicia bearing documents, the transport defining a paper path, means being situated along the paper path for scanning moving documents, said transport comprising:

a plurality of conveyor modules arranged end-to-end, said conveyor modules each having a plurality of parallel endless conveyor belts, gaps being present between adjacent of said conveyor modules;

means for imparting motion to the belts of said conveyor modules;

means for causing air to flow into said modules between said belts to thereby generate a low pressure differential across any document supported on said belts, the pressure differential holding the document against the belts during transport thereof;

means for ensuring movement of documents across the gaps between adjacent of said conveyor modules, the scanning means being situated for scanning a document which is traversing a said gap; and means for accelerating the motion of documents moving along the paper path, said accelerating means including a further conveyor module which spans the gap between an adjacent pair of said conveyor modules, said further conveyor module being inverted and partly overlapping the adjacent upstream and downstream ends of the conveyor modules of said pair whereby a document travelling on a conveyor module upstream of the spanned gap will be caused to move away from said upstream conveyor module and be engaged and transported by the inverted module and the document will be released by the inverted module onto the conveyor module at the downstream side of the spanned gap, the belt speed of the inverted and downstream conveyor modules being greater than the belt speed of the conveyor module located upstream of the spanned gap.

2. The apparatus of claim 1 wherein said means for ensuring movement of documents across the gaps between adjacent conveyor modules comprises pinch rollers cooperating with the conveyor belts of said modules at the upstream and downstream sides of said gaps.

3. The apparatus of claim 1 wherein said conveyor modules each further include a pair of spaced rollers which contact said conveyor belts and in part define the path of said belts, said conveyor modules also including means for maintaining the parallelism of said belts, said maintaining means comprising spacer discs which extend between adjacent of said belts, said maintaining means being offset so as to be closer to one of said rollers than the other said roller.

4. The apparatus of claim 1 wherein said transport further includes feeder means for serially supplying documents to the paper path adjacent the upstream end thereof, the documents being supplied and transported in a face-down orientation.

5. The apparatus of claim 4 wherein the scanning means is located beneath the paper path for scanning a moving document in a region thereof which is not supported by a transport mechanism which moves with the document.

6. The apparatus of claim 5 wherein said conveyor modules each further include a pair of spaced rollers which contact said conveyor belts and in part define the path of said belts, said conveyor modules also including means for maintaining the parallelism of said belts, said maintaining means comprising spacer discs which extend between adjacent of said belts, said maintaining means being offset so as to be closer to one of said rollers than the other said roller.

7. The apparatus of claim 4 further comprising:

means for orienting documents delivered into the paper path by said feeder means, said orienting means comprising a plurality of simultaneously movable fingers, said fingers having a first position where ends thereof extend across the paper path and between said parallel belts of one of said conveyor modules to define a stop line oriented perpendicularly with respect to the path of document movement defined by said belts, said finger means being rotatable to a second position where they are displaced from the paper path whereby said finger means may selectively and momentarily arrest the movement of a document traveling along said paper path, said belts moving relative to the document during the time motion thereof is arrested.

8. The apparatus of claim 1 wherein said transport is supported on a housing which contains electronic devices and wherein said air flow causing means at least in part comprises:

blower means for causing air to flow in said housing to conduct heat away from said electronics devices and to thereafter flow through at least some of said modules, said blower means including means pneumatically coupling said modules to said blower means.

9. The apparatus of claim 8 wherein said conveyor modules each further include a pair of spaced rollers which contact said conveyor belts and in part define the path of said belts, said conveyor modules also including means for maintaining the parallelism of said belts, said maintaining means comprising spacer discs which extend between adjacent of said belts, said maintaining means being offset so as to be closer to one of said rollers than the other said roller.

10. The apparatus of claim 1 wherein the transfer of documents between said upstream conveyor module and said inverted conveyor module and between said inverted conveyor module and said downstream conveyor module is achieved by controllably applying the pressure differential such that a document hold-down pressure will not be applied in the regions of an upstream located conveyor module which is overlapped by a downstream located conveyor module to which a document is to be transferred.

11. A paper transport for imparting motion to indicia bearing documents, the transport defining a document motion path and being supported on a housing which contains electronic devices, means being situated along said path for scanning moving documents, said transport comprising:

feeder means for serially supplying documents to the document motion path adjacent the upstream end thereof, the documents being supplied and transported in a face-down orientation;

a plurality of conveyor modules arranged end-to-end, said conveyor modules each having substantially the same construction wherein each of said conveyor modules comprises a plurality of parallel endless conveyor belts and a pair of spaced rollers which contact said conveyor belts and in part define the path of said belts, said conveyor modules also including means for maintaining the parallelism of said belts, said parallelism maintaining means comprising spacer discs which extend between adjacent of said belts, said parallelism maintaining means being offset so as to be closer to one of said rollers than the other said roller, gaps being present between adjacent of said conveyor modules;

means for imparting motion to the belts of said conveyor modules;

means for causing air to flow into said modules between said belts to thereby generate a low pressure differential across any document supported on said belts, the pressure differential holding the document against the belts during transport thereof, said air flow causing means comprising blower means for causing air to flow in said housing to conduct heat away from said electronics devices and to thereafter flow through at least some of said modules, said blower means including means pneumatically coupling said modules to said blower means;

means for ensuring movement of documents across the gaps between adjacent of said conveyor modules, said means for ensuring movement of documents across the gaps between adjacent conveyor modules comprising pinch rollers cooperating with the conveyor belts of said modules at the upstream and downstream sides of said gaps; and means for accelerating the motion of documents moving along the paper path, said accelerating means including a further conveyor module which spans the gap between an adjacent pair of said conveyor modules, said further conveyor module being inverted and partly overlapping the adjacent upstream and downstream ends of the conveyor modules of said pair whereby a document travelling on a conveyor module upstream of the spanned gap will be caused to move away from said upstream conveyor module and be engaged and transported by the inverted module and the document will be released by the inverted module onto the conveyor module at the downstream side of the spanned gap, the belt speed of the inverted and downstream conveyor modules being greater than the belt speed of the conveyor module located upstream of the spanned gap;

wherein all active devices which perform an operation on the documents are positioned adjacent the gaps between successive of said conveyor modules and wherein the lengths of said gaps may be selected as a function of the nature of the active device to be associated therewith and where the scanning means is located beneath the paper path for scanning a moving document which is traversing a said gap in a region thereof which is not supported by a transport mechanism which moves with the document.

12. The apparatus of claim 11 wherein said transport further includes feeder means for serially supplying documents to the paper path adjacent the upstream end thereof, the documents being supplied and transported in a face-down orientation.

13. The apparatus of claim 12 herein the scanning means is located beneath the paper path for scanning a moving document in a region thereof which is not supported by a transport mechanism which moves with the document.

14. The apparatus of claim 12 wherein said means for ensuring movement of documents across the gaps between adjacent conveyor modules comprises pinch rollers cooperating with the conveyor belts of said modules at the upstream and downstream sides of said gaps.

15. The apparatus of claim 14 wherein said conveyor modules each further include a pair of spaced rollers which contact said conveyor belts and in part define the path of said belts, said conveyor modules also including means for maintaining the parallelism of said belts, said maintaining means comprising spacer discs which extend between adjacent of said belts, said maintaining means being offset so as to be closer to one of said rollers than the other said roller.

16. The apparatus of claim 15 wherein said transport is supported on a housing which contains electronic devices and wherein said air flow causing means at least in part comprises:

blower means for causing air to flow in said housing to conduct heat away from said electronics devices and to thereafter flow through at least some of said modules, said blower means including means pneumatically coupling said modules to said blower means.

17. The apparatus of claim 11 wherein said conveyor modules each further include a pair of spaced rollers which contact said conveyor belts and in part define the path of said belts, said conveyor modules also including means for maintaining the parallelism of said belts, said maintaining means comprising spacer discs which extend between adjacent of said belts, said maintaining means being offset so as to be closer to one of said rollers than the other said roller.

18. A transport for imparting motion to indicia bearing documents, the transport defining a path, devices being situated along the path for performing document related processing operations, said transport comprising:

a plurality of conveyor modules arranged end-to-end, said conveyor modules each having a plurality of parallel endless conveyor belts for supporting the documents, gaps-being present between adjacent of said conveyor modules, the devices which perform document related processing operations being positioned in registration with said gaps between adjacent of said conveyor modules, the lengths of said gaps being selected as a function of the nature of the device to be in registration therewith;

means for imparting motion to the belts of said conveyor modules;

means for causing air flow into said modules between said belts to thereby generate a pressure differential across any document supported on said belts, the pressure differential holding the document against the belts during transport thereof; and means for ensuring movement of documents across said gaps between adjacent of said conveyor modules, the means for ensuring movement of documents across at least one of said gaps including a further one of said conveyor modules said further conveyor module having a plurality of parallel endless conveyor belts and being coupled to said means for causing air flow, said further conveyor module spanning said one gap, said further conveyor module partly overlapping the adjacent upstream and downstream ends of an adjacent pair of conveyor modules and being inverted with respect to the modules of said adjacent pair whereby a document travelling on a conveyor module upstream of said one gap will be caused to move away from the upstream conveyor module and be engaged and transported across the said one gap by the inverted module and the document will be released by the inverted module onto the conveyor module at the downstream side of said one gap.

19. The apparatus of claim 18 wherein said conveyor modules of said plurality and said further conveyor module each additionally include a pair of spaced rollers which contact said conveyor belts and in part define the path of said belts, said conveyor modules and further conveyor module also including means for maintaining the parallelism of said belts, said parallelism maintaining means comprising spacer discs which extend between adjacent of said belts, said maintaining means being offset so as to be closer to one of said rollers than the other said roller.

20. The apparatus of claim 18 further comprising:

means for orienting documents delivered into said path, said orienting means comprising a plurality of simultaneously movable fingers, said fingers having a first position where ends thereof extend across said path and between said parallel belts of one of said conveyor modules to define a stop line oriented perpendicularly with respect to the path of document movement defined by said belts, said finger means being rotatable to a second position where they are displaced from said path whereby said finger means may selectively and momentarily arrest the movement of a document traveling along said path, said belts moving relative to the document during the time motion thereof is arrested.

* * * * *